US005643110A

United States Patent [19]

Igarashi

[11] Patent Number: 5,643,110

[45] Date of Patent: *Jul. 1, 1997

[54] GOLF WOOD CLUB WITH SMOOTH GROOVE-FREE FACE

[76] Inventor: Lawrence Y. Igarashi, 30231 Tomas Rd., Rancho Santa Margarita, Calif. 92688

[ * ] Notice: The term of this patent shall not extend beyond the expiration date of Pat. No. 5,480,153.

[21] Appl. No.: 578,156

[22] Filed: Dec. 29, 1995

Related U.S. Application Data

[60] Division of Ser. No. 360,884, Dec. 21, 1994, Pat. No. 5,480,153, which is a continuation-in-part of Ser. No. 250, 798, May 27, 1994, abandoned.

[51] Int. Cl.[6] ..... A63B 53/04

[52] U.S. Cl. ..... 473/330; 473/345

[58] Field of Search ..... 473/324, 329, 473/330, 331, 342, 345, 350

[56] References Cited

U.S. PATENT DOCUMENTS

| | | | |
|---|---|---|---|
| 3,870,314 | 3/1975 | Bertucci | 473/141 |
| 4,534,564 | 8/1985 | Yamada | 473/345 |
| 4,569,524 | 2/1986 | Quijano | 473/342 |
| 4,624,460 | 11/1986 | Murase | 473/348 |
| 4,792,140 | 12/1988 | Yamaguchi | 473/349 |
| 4,917,384 | 4/1990 | Caiati | 473/330 |
| 5,028,049 | 7/1991 | McKeighen | 473/345 |
| 5,094,383 | 3/1992 | Anderson | 473/345 |
| 5,176,383 | 1/1993 | Duclos | 473/342 |
| 5,480,153 | 1/1996 | Igarashi | 473/345 |

*Primary Examiner*—Sebastiano Passaniti
*Attorney, Agent, or Firm*—Larry K. Roberts

[57] ABSTRACT

A golf driver club having a face which is smooth and free of grooves or other indentations at the ball-impacting surface. The club includes a hollow metal club body with the ball-impacting surface formed from a rigid, non-resilient metal. The ball-impacting surface is highly polished to obtain the smoothness. The golf driver club tends to result in drives wherein the ball does not spin, providing improved accuracy and drive distance.

28 Claims, 1 Drawing Sheet

FIG. 2
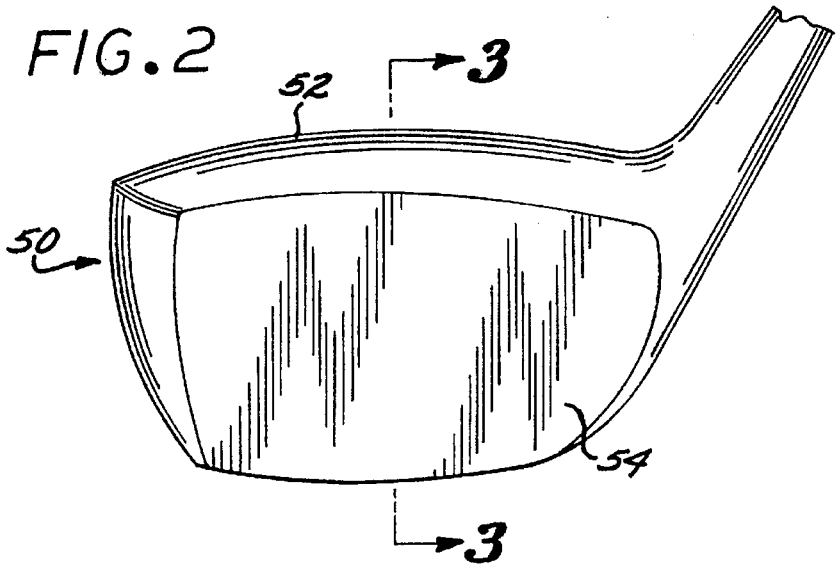
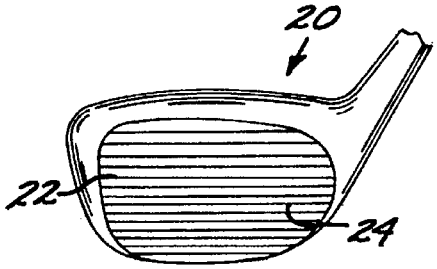
FIG. 1 PRIOR ART
FIG. 3
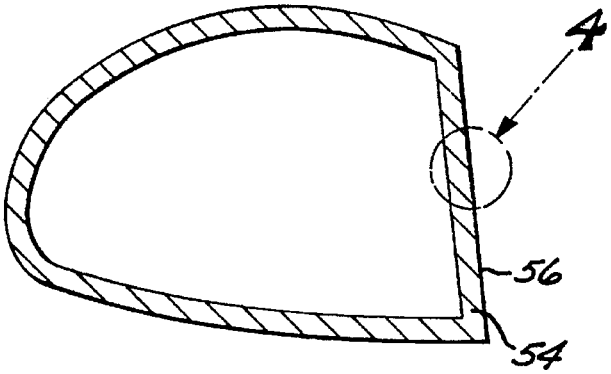
FIG. 4
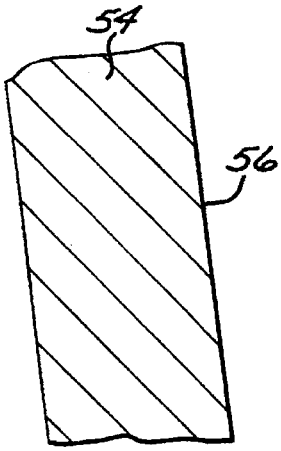
FIG. 5
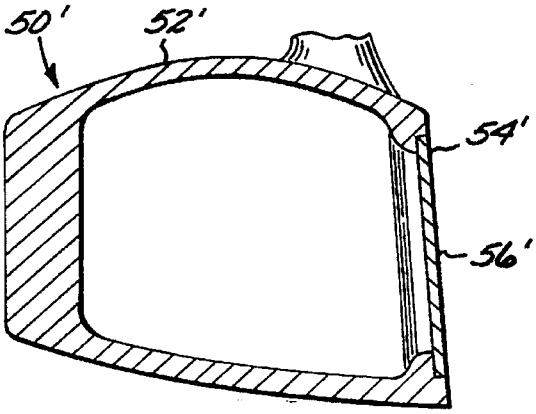

GOLF WOOD CLUB WITH SMOOTH GROOVE-FREE FACE

This is a divisional of application Ser. No. 08/360,884 filed on Dec. 21. 1994, now U.S. Pat. No. 5,480,153, which is a continuation-in-part of application Ser. No. 08/250,798, filed May 27, 1994, now abandoned.

TECHNICAL FIELD OF THE INVENTION

The present invention is related to the field of golf club equipment, and more particularly to an improved golf driver.

BACKGROUND OF THE INVENTION

It is conventional in the golf club industry to fabricate wood club heads with a ball-impacting face having a series of aligned grooves formed therein. "Wood" club heads can be made of wood, or more commonly today, of metal. As used herein, "wood" clubs refer to the class of golf clubs including the driver, typically known as the number one wood, and the fairway woods, typically the number three, four, five and seven woods. The ball-impacting face of the number one wood typically is inclined from the vertical in the range of 7 to 13 degrees, while the faces of the fairway woods have a greater inclination, e.g., 13–17 degrees for the number three wood, 20 degrees or so for the number four wood, 23 degrees for the number five wood, and 27 degrees for the number seven wood. This invention is an improvement in the golf driver or number one wood clubs.

FIG. 1 illustrates a conventional wood club head 20 having a ball-impacting face 22 with a pattern of horizontal, aligned grooves 24 formed therein. The grooves or other patterned indentations, however, tend to impart spin to the golf ball, and can therefore contribute to slicing or hooking the ball, or to causing the ball to lift or drop appreciably. The spin imparted to the ball can thus adversely affect the accuracy and the distance of a player's shot.

Golf play often occurs in wet conditions, due to early morning dew on the course grass, rain, drizzle, irrigation or the like. Water which adheres to the ball-impacting face of the golf club can reduce the energy transfer between the face and the ball, and therefore affect the play.

SUMMARY OF THE INVENTION

A golf wood club is described, comprising a head body, and a face having a rigid metal., ball-impacting surface which is smooth and free of grooves and indentations. As a result of the smoothness of the ball-impacting surface, the club tends not to impart spin to the ball, thereby providing improved accuracy and drive length.

In a preferred embodiment, the club head is an integral one piece metal structure, wherein the faceplate is fabricated as an integral part of the club body. In an alternate embodiment, the club head body and faceplate are separate elements, with the faceplate attached to the body. The club head body may be fabricated of materials such as graphite or plastic, with the faceplate fabricated of metal such as titanium, a titanium alloy, stainless steel or aluminum.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 illustrates a conventional wood club head having a grooved ball-impacting face surface.

FIG. 2 is a front elevation view of a golf driver club head embodying the invention.

FIG. 3 is a cross-sectional view taken along line 3—3 of FIG. 2.

FIG. 4 is an enlarged view of the portion of the structure of FIG. 3 indicated by the phantom circle.

FIG. 5 is a cross-sectional view of an alternate embodiment of a golf driver club head embodying the invention.

DETAILED DESCRIPTION OF THE PREFERRED EMBODIMENT

Instead of following the conventional wisdom of providing the face with a series of grooves or other indentations, a golf wood driver club head in accordance with this invention is characterized by a rigid face having as smooth and non-porous a ball-impacting surface as practicable. With this rigid, smooth, groove-free surface, the ball does not tend to spin. As a result, the distance of the player's shot is increased, and the accuracy of the shot is improved, since the ball does not curve due to spin. The invention provides a golf wood driver club which allows a player to hit with more accuracy and longer distance than with a conventional driver having a grooved face.

FIGS. 2–4 illustrate a preferred embodiment of a wood driver club head 50 embodying this invention. The club head 50 is a hollow metal shell to provide perimeter weighting. The head 50 includes a head body 52 and a face area 54. The face 54 is constructed as an integral part of the club body 52, e.g., as described in applicant's copending application Ser. No. 08/156,613, filed Nov. 23, 1993. Preferred metals for the body and face include stainless steel, aluminum and titanium alloys, including titanium 6/4 (TI 6/4). As is well known in the art, the face region is not truly planar, but has a radius of curvature both from the heel to the toe region and from the top of the club head to the bottom. This invention does not affect the well-known curvature of the face region.

The ball-impacting face surface 56 is inclined from the vertical by an inclination angle in the range of 7 to 13 degrees.

It is a feature of this invention that the ball impacting surface 56 have no grooves or other indentations or protrusions formed therein. Further, it is desired that the surface 56 be as smooth as possible, with no roughness or pits in the surface. In a preferred implementation, this smoothness may be attained by highly polishing the surface of the face 54.

In a preferred embodiment, the club head is fabricated by a casting process, wherein the face 54 is integrally formed during the casting process with the club head body. Upon completion of the casting process, the club head blank removed from the casting mold. Any surface roughness of the face 54 is removed by a grinding and polishing process. One exemplary grinding and polishing process includes the following steps. First, the face is roughly ground by application of a 120 grit belt. Secondly, a 180 grit Scotch Brite™ scrubbing wheel is used to more finely grind the surface. Lastly, a polishing compound is used to prepare the smooth surface of the ball-impacting face.

In a preferred embodiment, a polyurethane paint coats the club head, except for the ball-impacting surface, which remains free of any coating.

The resulting ball-impacting surface of the club head is extremely smooth and non-porous, and since there are no grooves or other indentations in the surface 56, the impact of the head on the ball does not tend to impart spin on the ball. Since the ball travels with little or no spin, the ball does not tend to curve during flight. As a result, the ball does not tend to hook, slice, sky or drop to the same degree as with a conventional club head with a grooved face. Moreover, the lack of spin leads to longer drives. Thus, the smooth, groove-free face provides improved play over conventional golf drivers.

FIG. 5 illustrates an alternate embodiment of a driver club head embodying the invention. In this embodiment, the club head 50 comprises a club head body 52' and a separate faceplate 54'. The club head body 52' can be fabricated and attached to the faceplate in the manner described in application Ser. No. 07,970,708, filed Nov. 3, 1992, "Golf Club with Faceplate of Titanium or Other High Strength Lightweight Materials," by the applicant herein, the entire contents of which are incorporated herein by this reference. The body 52' can be fabricated of a metal such as titanium, titanium alloy (TI 6/4), stainless steel or aluminum. Other suitable materials for the body 52 include graphite or a plastic material, such as ABS or polycarbonate. The faceplate 54' is fabricated of titanium or titanium alloy (TI 6/4), aluminum or stainless steel.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A golf wood-type club, comprising a hollow club head body and a rigid metal, non-resilient ball-impacting faceplate having a ball-impacting surface which is smooth and free of grooves and indentations, thereby minimizing any impartation of spin to a golf ball upon impact with said ball-impacting face.

2. The golf club of claim 1 wherein said faceplate is fabricated from a metal selected from the group consisting of titanium, titanium alloys, aluminum and stainless steel.

3. The golf club of claim 1 wherein said ball-impacting face is inclined from the vertical by an inclination angle in the range between 7½ to 12 degrees.

4. The golf club of claim 1 wherein said ball-impacting surface is free of any coating.

5. The golf club of claim 1 wherein said club head body is fabricated from graphite.

6. The golf club of claim 1 wherein said club head body is fabricated of a plastic material, said plastic material comprising ABS or polycarbonate.

7. The golf club of claim 1 wherein said club head body is fabricated of a metal.

8. The golf wood-type club of claim 1, wherein said ball-impacting surface is non-porous.

9. The golf wood-type club of claim 1, wherein said ball-impacting surface is free of surface roughness or pits.

10. A method for fabricating a golf driver club, comprising the steps of:

providing a hollow club head body;

providing a rigid metal, non-resilient ball-impacting faceplate for said club head body, said faceplate having a ball-impacting surface which is smooth and free of grooves and indentations, thereby minimizing any impartation of spin to a golf ball upon impact with said ball-impacting face.

11. The method of claim 10 wherein said faceplate is fabricated from a metal selected from the group consisting of titanium, titanium alloys, aluminum and stainless steel.

12. The method of claim 10 wherein said ball-impacting face is inclined from the vertical by an inclination angle in the range between 7½ to 12 degrees.

13. The method of claim 10 wherein said ball-impacting surface is free of any coating.

14. The method of claim 10 wherein said club head body is fabricated from graphite.

15. The method of claim 10 wherein said club head body is fabricated of a plastic material, said plastic material comprising ABS or polycarbonate.

16. The method of claim 10 wherein said club head body is fabricated of a metal.

17. The method of claim 10, wherein said ball-impacting surface is non-porous.

18. The method of claim 10, wherein said ball-impacting surface is free of surface roughness or pits.

19. A method for fabricating a golf driver club, comprising the steps of:

providing a hollow metal club head body having a metal faceplate, the faceplate defining a rigid, non-resilient ball-impacting surface;

processing the faceplate to provide a ball-impacting surface which is smooth and free of grooves and indentations, thereby minimizing any impartation of spin to a golf ball upon impact with said ball-impacting face.

20. The method of claim 19 wherein said body and said faceplate are fabricated as an integral metal structure.

21. The method of claim 19 wherein said body and said faceplate are fabricated as separate metal structures, and said body and faceplate are secured together to define said body.

22. The method of claim 19 wherein said metal is fabricated from a metal selected from the group consisting of titanium, titanium alloys, aluminum and stainless steel.

23. The method of claim 19 wherein said ball-impacting face is inclined from the vertical by an inclination angle in the range between 7½ to 12 degrees.

24. The method of claim 19 wherein said ball-impacting surface is free of any coating.

25. The method of claim 19, wherein said ball-impacting surface is non-porous.

26. The method of claim 19, wherein said ball-impacting surface is free of surface roughness or pits.

27. A method for fabricating a golf driver club, comprising the steps of:

providing a hollow metal club head body having a faceplate, the faceplate defining a rigid, ball-impacting surface;

processing the faceplate to provide a ball-impacting surface which is smooth and free of grooves and indentations, including grinding the faceplate surface to smooth said surface such that it is free of grooves and indentations, thereby minimizing any impartation of spin to a golf ball upon impact with said ball-impacting face.

28. The method of claim 27 wherein the step of processing the faceplate includes polishing the faceplate surface after grinding said surface.

* * * * *